US011131445B2

(12) United States Patent
Collado et al.

(10) Patent No.: US 11,131,445 B2
(45) Date of Patent: Sep. 28, 2021

(54) LIGHTING ASSEMBLY

(71) Applicant: QTran, Inc., Milford, CT (US)

(72) Inventors: Justin I. Collado, Naugatuck, CT (US); Samuel L. Jacobson, Westford, MA (US)

(73) Assignee: QTran, Inc., Milford, CT (US)

( * ) Notice: Subject to any disclaimer, the term of this patent is extended or adjusted under 35 U.S.C. 154(b) by 0 days.

(21) Appl. No.: 16/786,741

(22) Filed: Feb. 10, 2020

(65) Prior Publication Data

US 2021/0247056 A1 Aug. 12, 2021

Related U.S. Application Data

(60) Provisional application No. 62/971,740, filed on Feb. 7, 2020.

(51) Int. Cl.

| | |
|---|---|
| ***F21V 21/02*** | (2006.01) |
| ***F21V 17/08*** | (2006.01) |
| ***F21V 17/12*** | (2006.01) |
| ***F21V 17/10*** | (2006.01) |
| ***F21V 17/06*** | (2006.01) |

(52) U.S. Cl.

CPC ..... *F21V 21/02* (2013.01); *F21V 17/06* (2013.01); *F21V 17/08* (2013.01); *F21V 17/104* (2013.01); *F21V 17/12* (2013.01)

(58) Field of Classification Search

CPC ..... F21V 21/02; F21V 17/06; F21V 17/08; F21V 17/104; F21V 17/12

See application file for complete search history.

(56) References Cited

U.S. PATENT DOCUMENTS

| | | | | |
|---|---|---|---|---|
| 2007/0081325 | A1* | 4/2007 | Shwisha | F21S 8/033 362/145 |
| 2007/0263396 | A1* | 11/2007 | Miller | F21V 27/00 362/432 |
| 2018/0156400 | A1* | 6/2018 | Lomenzo | F21S 8/033 |

* cited by examiner

*Primary Examiner* — Rajarshi Chakraborty
*Assistant Examiner* — Nathaniel J Lee
(74) *Attorney, Agent, or Firm* — Ware, Fressola, Maguire & Barber LLP

(57) ABSTRACT

The present invention is directed to a lighting assembly configured for use in direct and indirect lighting applications. The lighting assembly may include a channel having a body base and a wall substantially perpendicularly from a side of the body base, and an elongated wing having a slab with a first substantially flat side, and a second side opposite the first substantially flat side from which an arm extends. The lighting assembly may also include a panel having an elongated strip and a raceway positioned at least substantially perpendicular to the elongated strip.

8 Claims, 22 Drawing Sheets

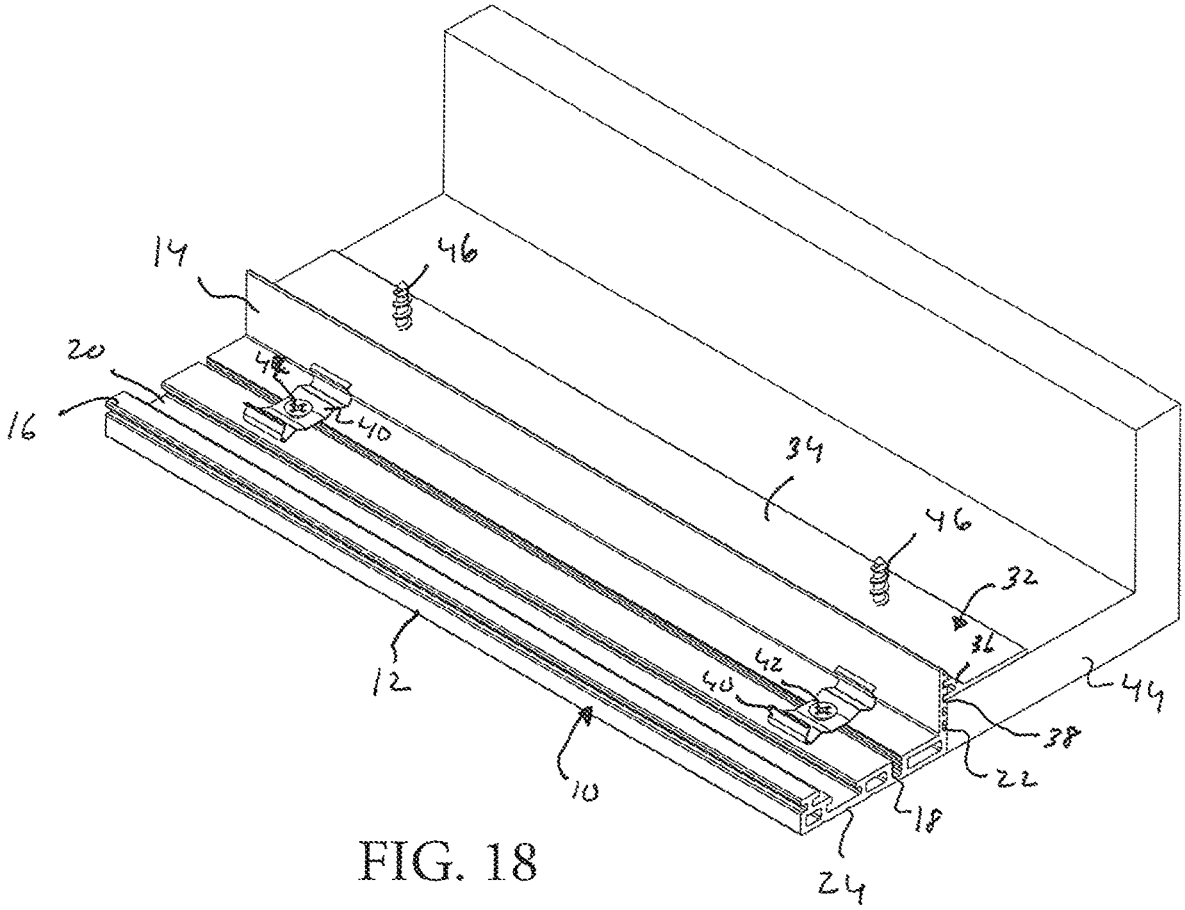
FIG. 18
FIG. 19
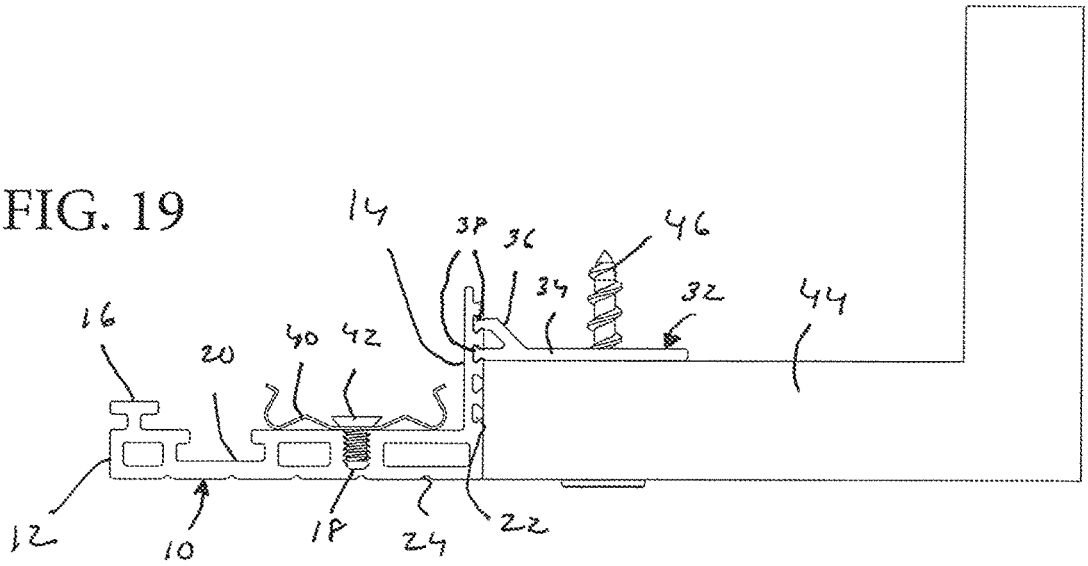

LIGHTING ASSEMBLY

BACKGROUND OF THE INVENTION

1. Field of the Invention

The present invention generally relates to a lighting assembly, and more particularly to a lighting assembly that can be configured for direct and indirect lighting applications.

SUMMARY OF THE INVENTION

Exemplary embodiments of the present invention are directed to a lighting assembly that is configured direct and indirect lighting applications.

It is an object of the present invention to provide a lighting assembly that can be installed on wallboard, or other wall constructing material, in either a direct lighting or an indirect lighting application.

It is another object of the present invention to provide a lighting assembly that can be visually integrated into the adjacent wallboard on which it may be installed.

It is still another object of the present invention to provide a lighting assembly that can be adjusted to a desired recessed depth relative to adjacent wallboard.

It is another object of the present invention to provide a lighting assembly that can be adjusted to be at least substantially flush relative to adjacent wallboard.

It is yet another object of the present invention to provide a lighting assembly that can receive and retain a variety of lighting elements, and is suitable for various lighting applications.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which:

FIG. 18 is a perspective view of a stage of an exemplary indirect lighting installation process for the lighting assembly according to an exemplary aspect of the present invention;

FIG. 19 is a front view of a stage of an exemplary indirect lighting installation process for the lighting assembly according to an exemplary aspect of the present invention;

DETAILED DESCRIPTION OF THE INVENTION

Figure 1:
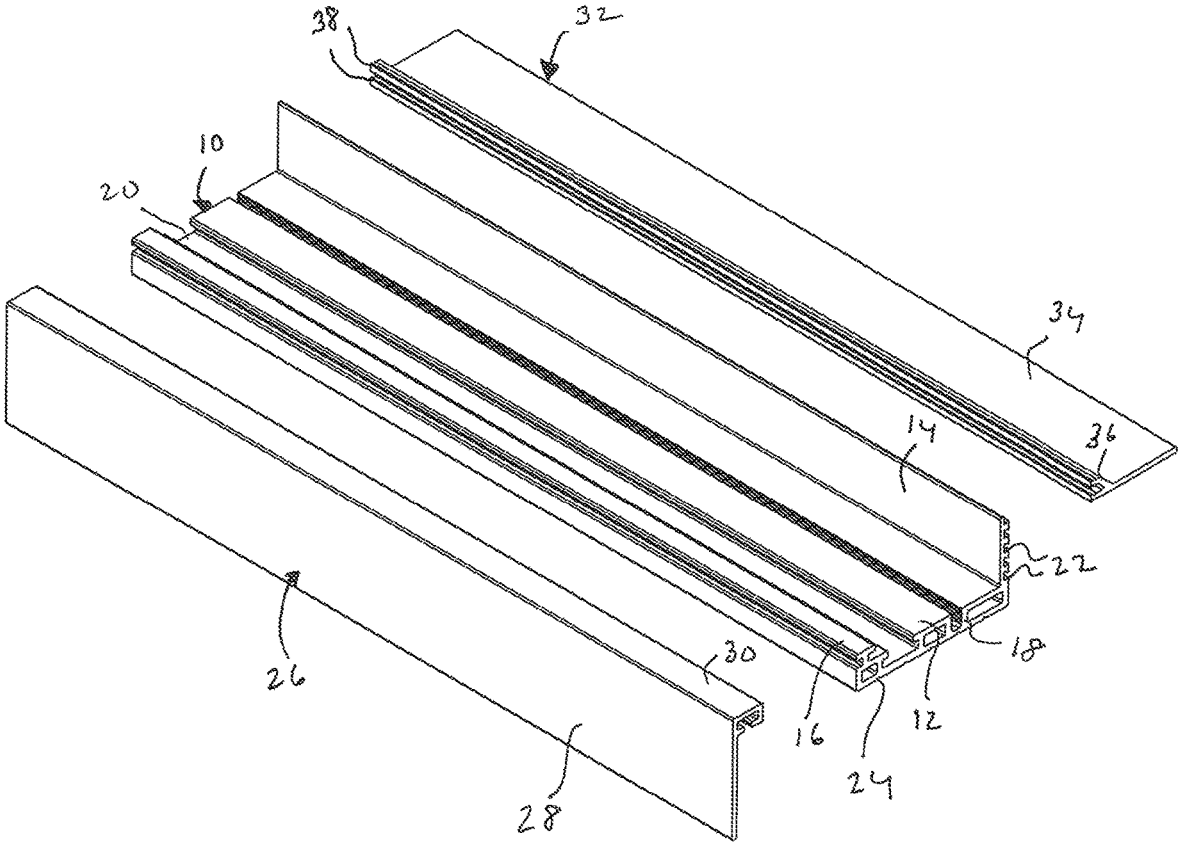
FIG. 1 is an exploded perspective view of a lighting assembly according to an exemplary aspect of the present invention.
Figure 1A:
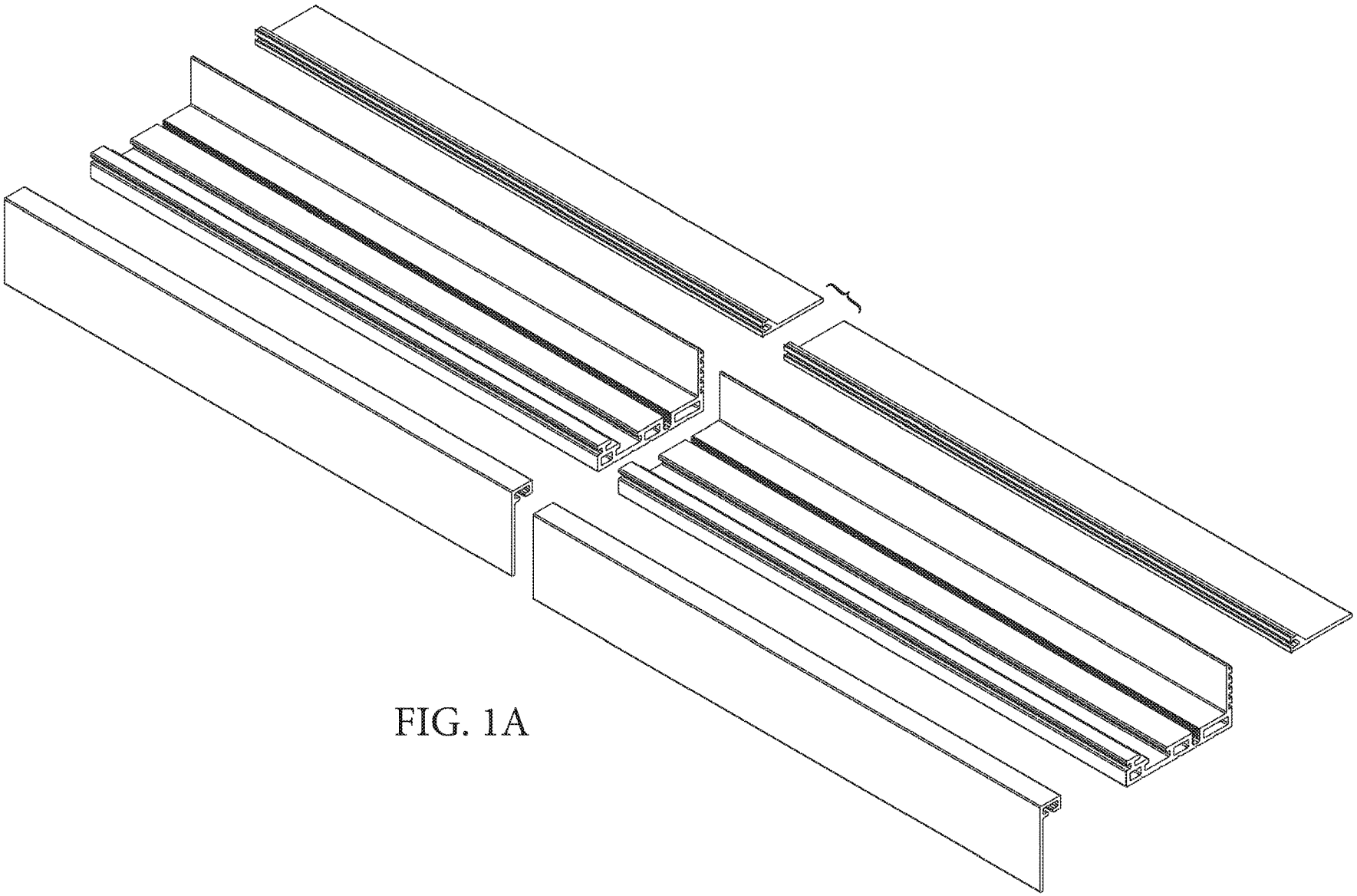
FIG. 1A is the view from FIG. 1 having a symbolic break illustrating that the lighting assembly may have an indeterminate length.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 2:
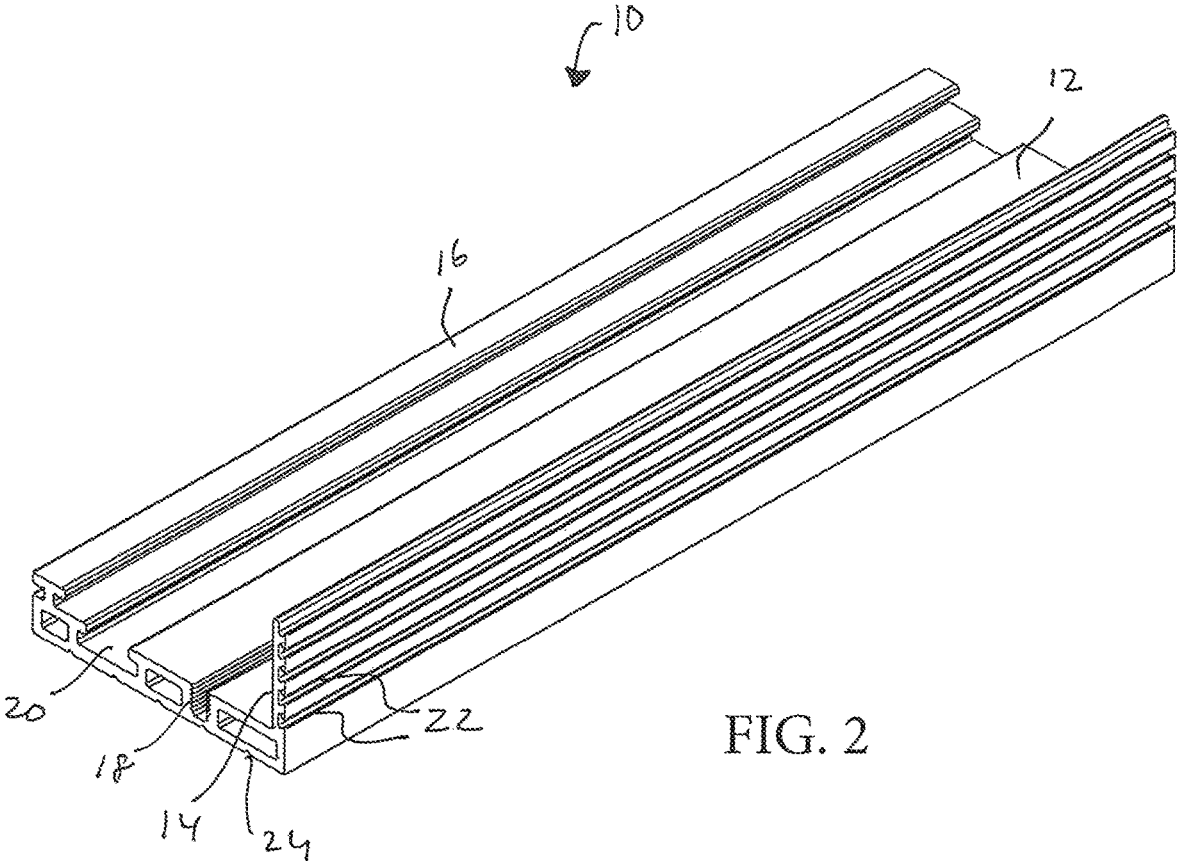
FIG. 2 is a perspective view of an exemplary channel of the lighting assembly according to an exemplary aspect of the present invention.
Figure 3:
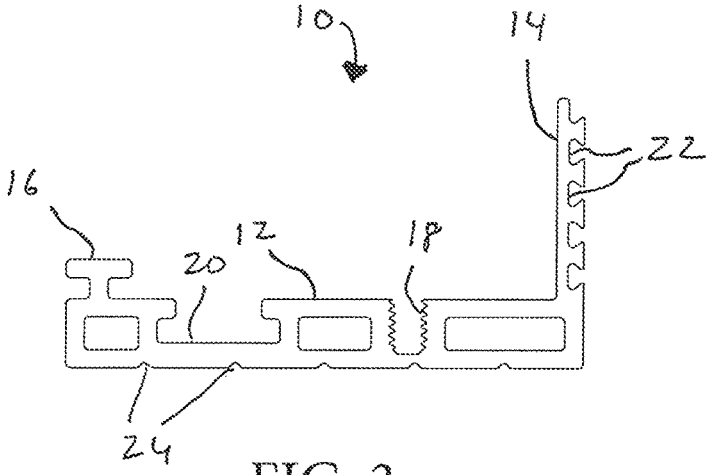
FIG. 3 is a front view of the exemplary channel of the lighting assembly according to an exemplary aspect of the present invention.
Figure 2A:
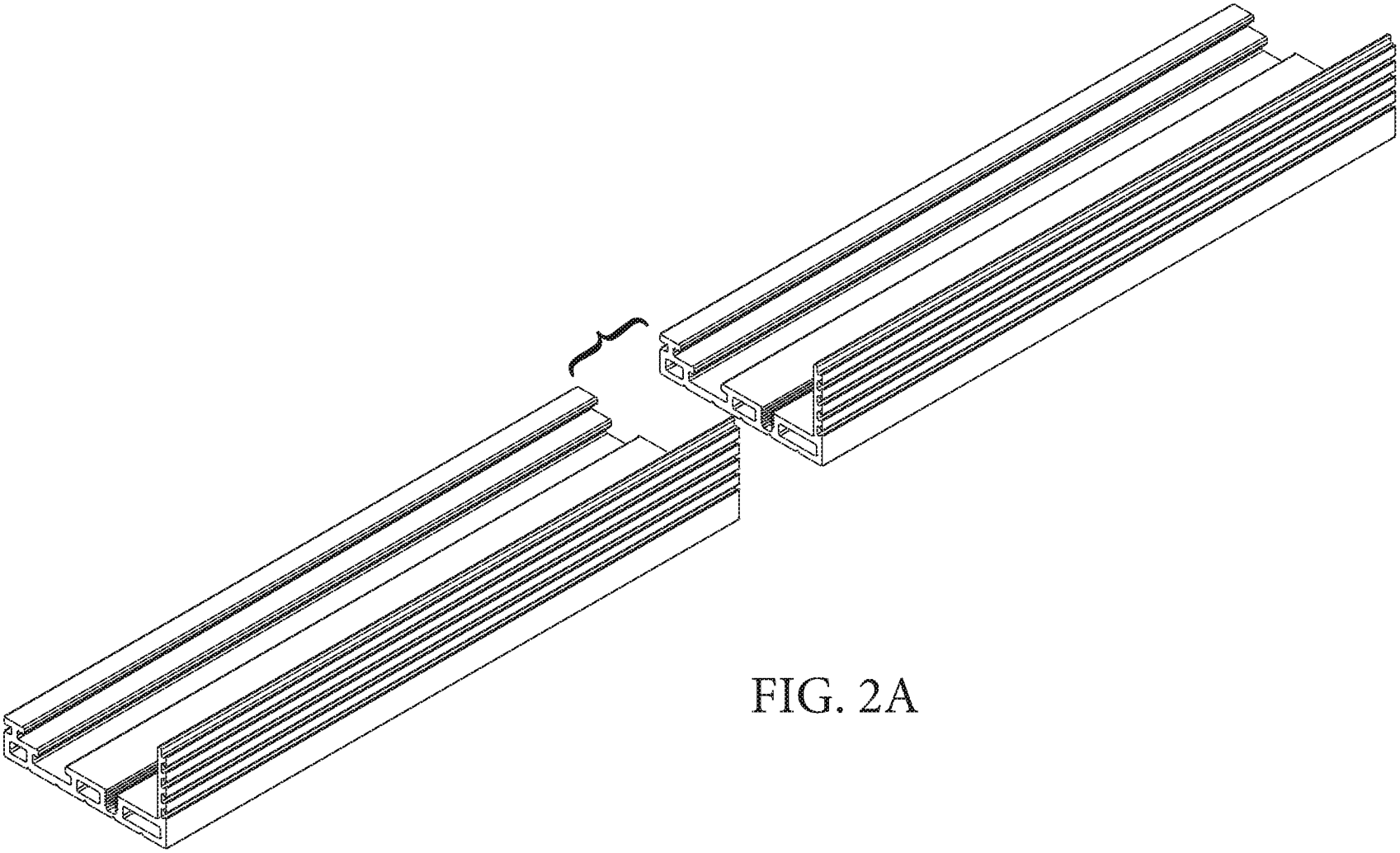
FIG. 2A is the view from FIG. 2 having a symbolic break illustrating that the channel may have an indeterminate length.

Referring now to FIGS. 1-3, therein illustrated is an exemplary embodiment of a channel, generally indicated by reference numeral 10, according to an exemplary aspect of the present invention for use with the lighting assembly according to an exemplary aspect of the present invention. The channel 10 may include a body base 12 and a wall 14 extending at least substantially perpendicularly from a side of the body base 12. The wall 14 may extend at least partially the length of the body base 12. The channel 10 may also include a rail 16 extending from the other side of the body base 12 opposite the wall 14, and the rail 16 may extend at least partially the length of the body base 12. The rail 16 may have a substantially "T-shaped" cross-section, but it is understood that the present invention is not limited to any particular cross-sectional shape of the rail 16. The channel 10 may further include a threaded track 18 formed in the body base 12. The threaded track 18 may extend at least partially the length of the body base 12. While a single threaded track 18 is shown in the figures, it is understood that the channel 10 may include one or more threaded tracks 18 spaced along the length of the body base 12. The channel 10 may also include a slot 20 formed in the body base 12, and extending at least partially along the length of the body base 12. The wall 14 of the channel 10 may include one or more grooves 22 formed in a side of the wall 14 facing opposite the body base 12. The grooves 22 may be formed so that an opening of each groove 22 is smaller than an internal dimension of the groove 22. The one or more grooves 22 may extend the entire length of the wall 14, or the one or more grooves 22 may be spaced along the wall 14 in intervals. The body base 12 may also include one or more furrows 24 formed in a side of the body base 12 that may be opposite the threaded track 18 and slot 20.

Figure 4:
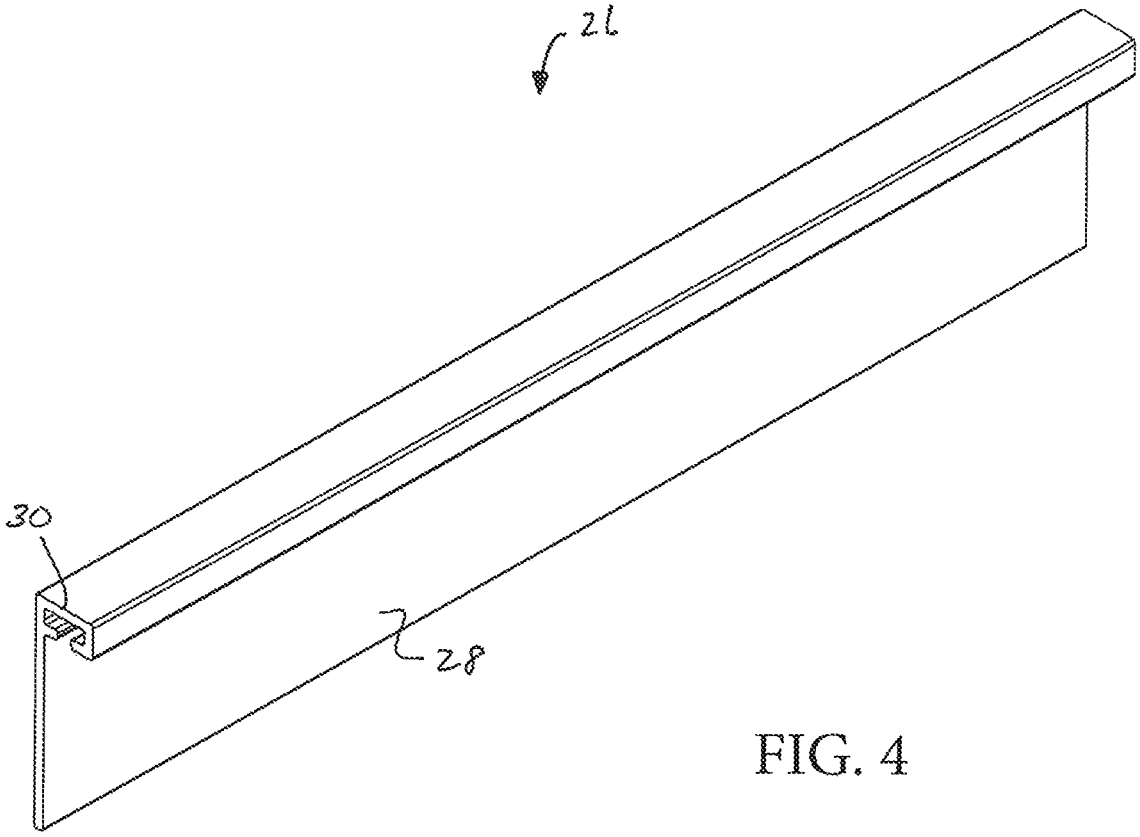
FIG. 4 is a perspective view of an exemplary panel of the lighting assembly according to an exemplary aspect of the present invention.
Figure 5:
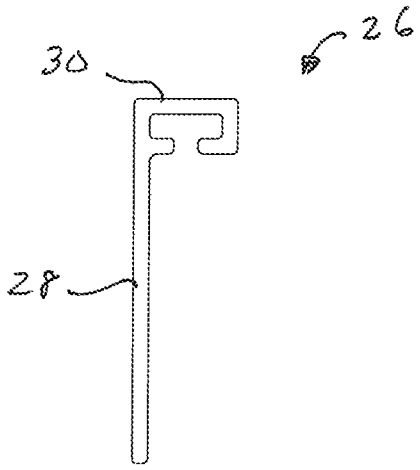
FIG. 5 is a front view of the exemplary panel of the lighting assembly according to an exemplary aspect of the present invention.
Figure 14:
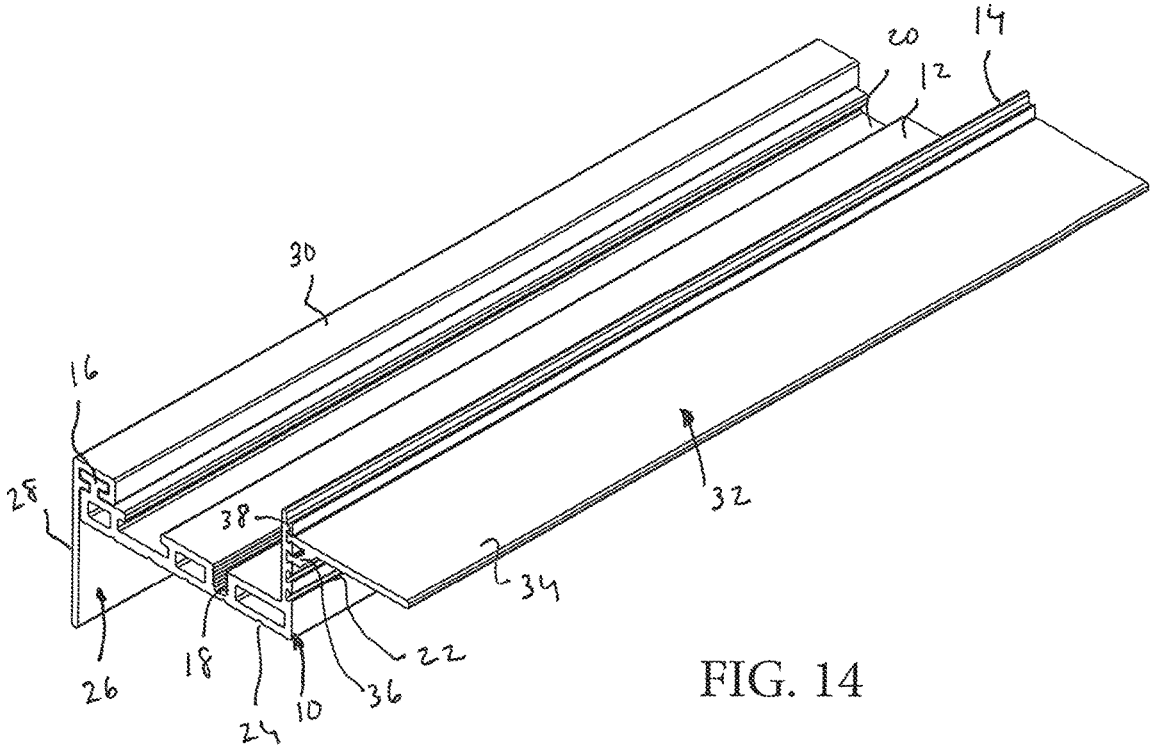
FIG. 14 is a perspective view of an exemplary direct lighting configuration for the lighting assembly according to an exemplary aspect of the present invention.
Figure 15:
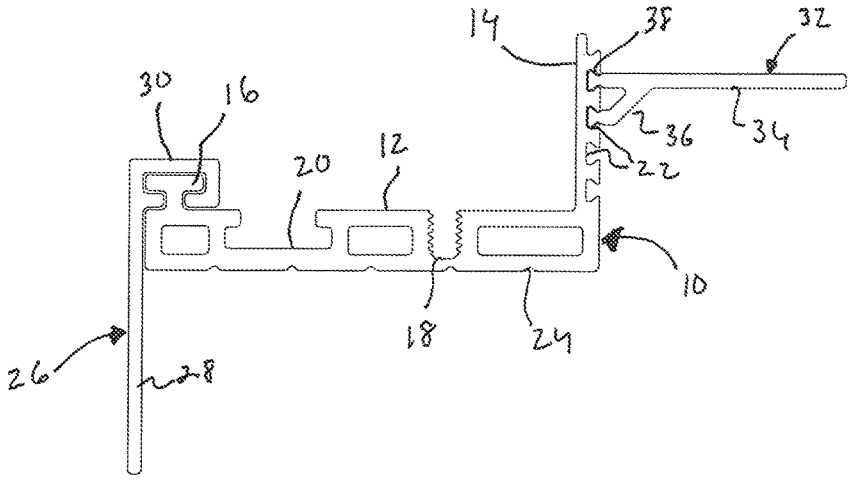
FIG. 15 is a front view of the exemplary direct lighting configuration for the lighting assembly according to an exemplary aspect of the present invention.
Figure 14A:
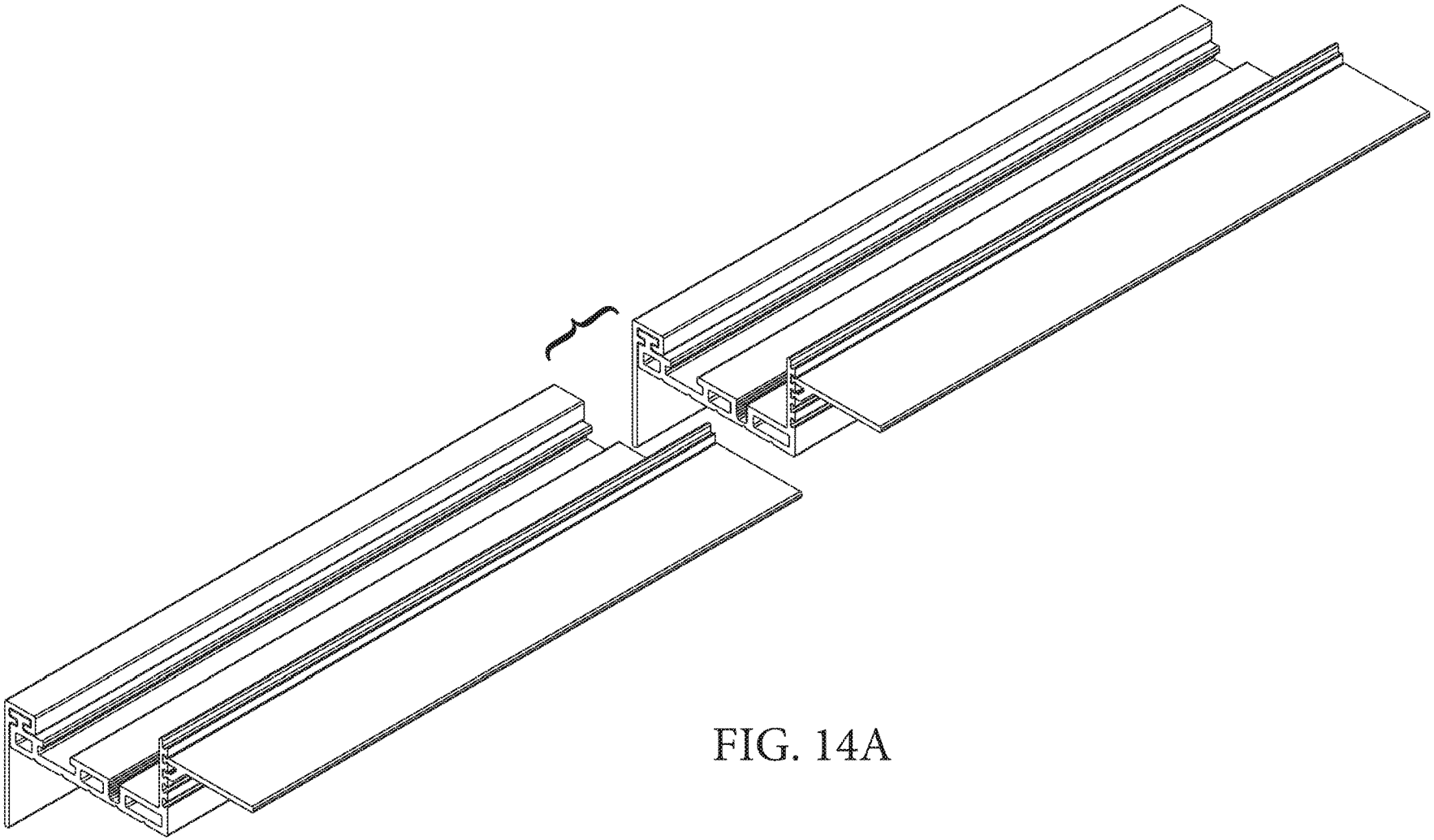
FIG. 14A is the view from FIG. 14 having a symbolic break illustrating that the lighting assembly may have an indeterminate length.

Referring now to FIGS. 1 and 4-5, therein illustrated is an exemplary embodiment of a panel 26, generally indicated by reference numeral 26, according to an exemplary aspect of the present invention for use with the lighting assembly according to an exemplary aspect of the present invention. The panel 26 may include an elongated strip 28 and a raceway 30 positioned at least substantially perpendicular to the elongated strip 28. As discussed further below, the raceway 30 may be complementarily shaped and sized to accommodate the rail 16 in order to allow for cooperative connection of the panel 26 with the channel 10, for example as illustrated in FIGS. 14 and 15.

Figure 6:
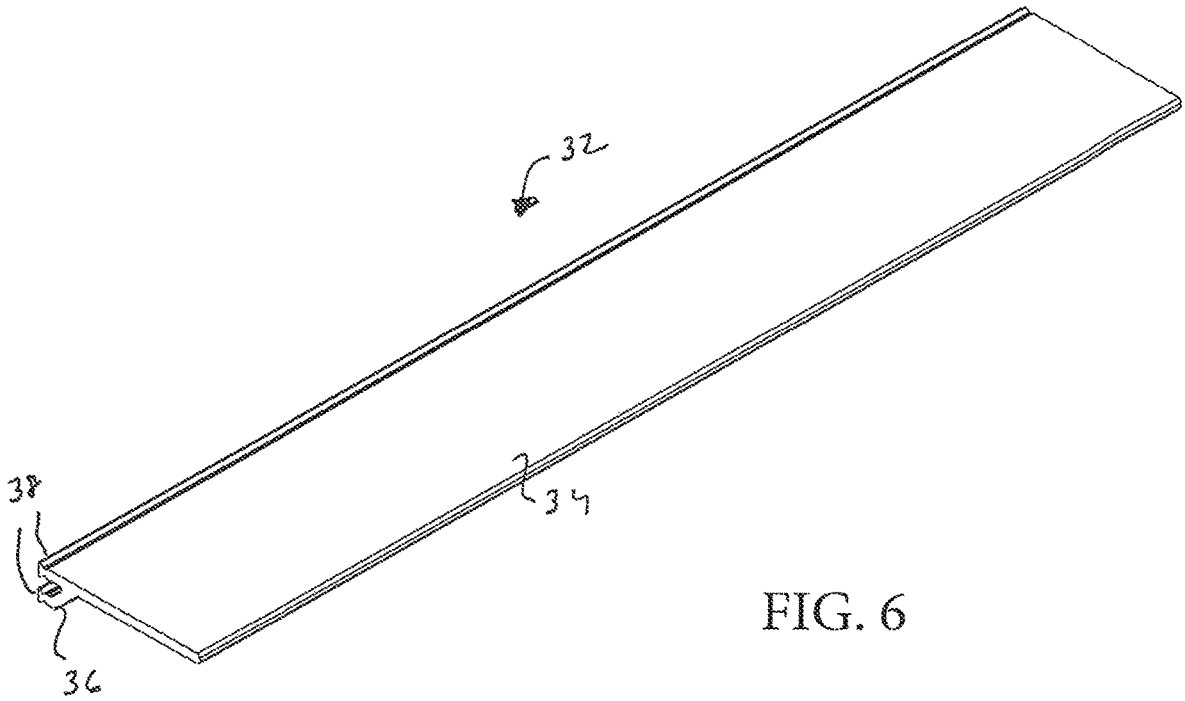
FIG. 6 is a perspective view of an exemplary elongated wing of the lighting assembly according to an exemplary aspect of the present invention.
Figure 7:
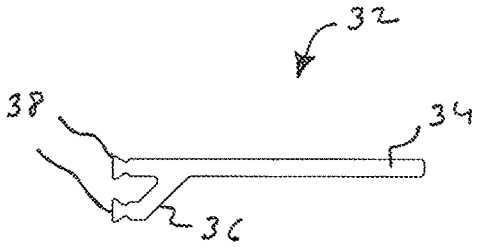
FIG. 7 is a front view of the exemplary elongated wing of the lighting assembly according to an exemplary aspect of the present invention.
Figure 8:
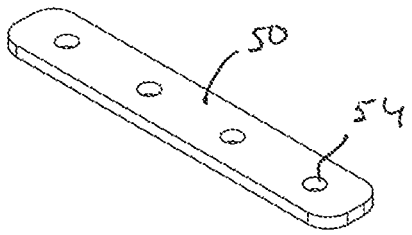
FIG. 8 is a perspective view of an exemplary straight connector for use with the lighting assembly according to an exemplary aspect of the present invention.
Figure 9:
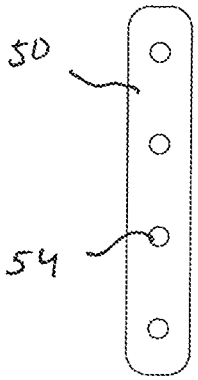
FIG. 9 is a top view of the exemplary straight connector for use with the lighting assembly according to an exemplary aspect of the present invention.
Figure 10:
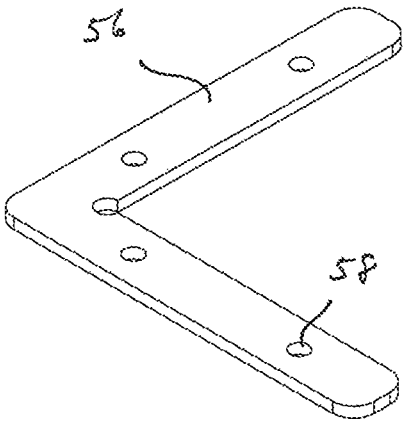
FIG. 10 is a perspective view of an exemplary miter connector for use with the lighting assembly according to an exemplary aspect of the present invention.
Figure 11:
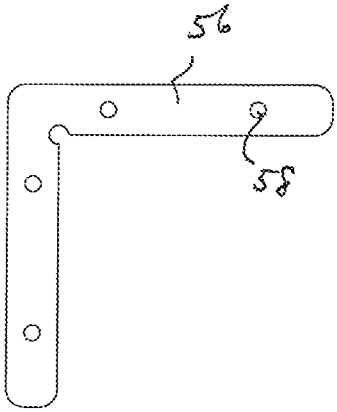
FIG. 11 is a top view of the exemplary miter connector for use with the lighting assembly according to an exemplary aspect of the present invention.
Figure 12:
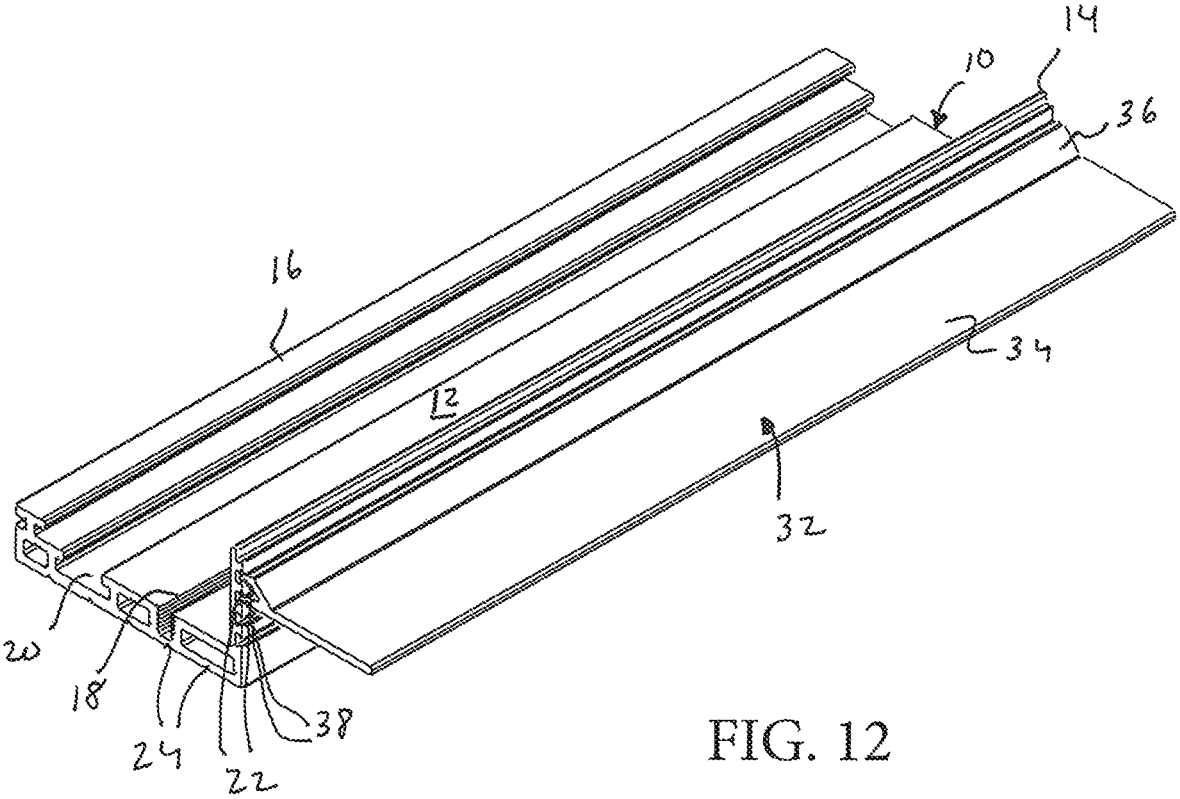
FIG. 12 is a perspective view of an exemplary indirect lighting configuration for the lighting assembly according to an exemplary aspect of the present invention.
Figure 13:
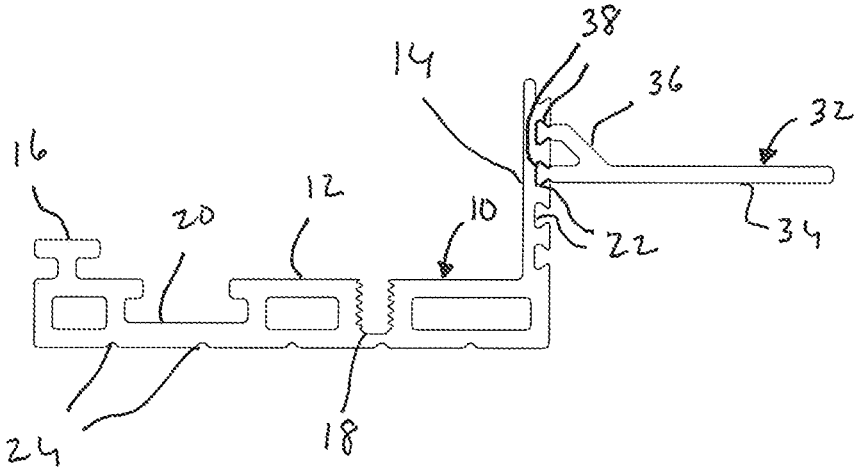
FIG. 13 is a front view of the exemplary indirect lighting configuration for the lighting assembly according to an exemplary aspect of the present invention.
Figure 12A:
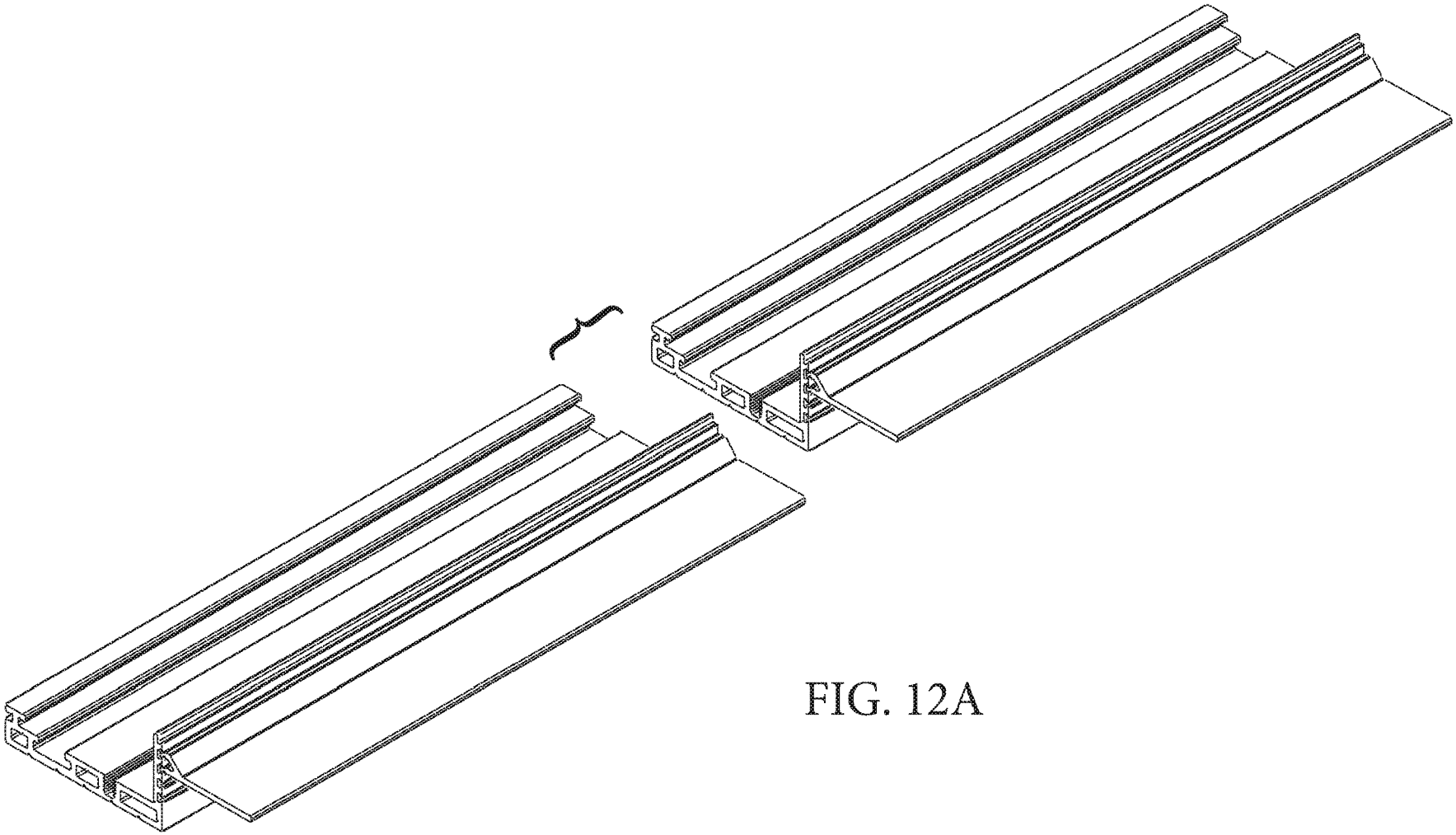
FIG. 12A is the view from FIG. 12 having a symbolic break illustrating that the lighting assembly may have an indeterminate length.

Referring now to FIGS. 1 and 6-7, therein illustrated is an exemplary embodiment of an elongated wing, generally indicated by reference numeral 32, according to an exemplary aspect of the present invention for use with the lighting assembly according to an exemplary aspect of the present invention. The elongated wing 32 may include a slab 34 having a first substantially flat side, and a second side opposite the first substantially flat side from which an arm 36 extends. The arm 36 may run the entire length of the elongated wing 32 or may extend from the slab 34 at certain intervals. The arm 36 and the edge of the slab 34 adjacent to the arm 36 may end in a foot 38 that may extend the length of the arm and the slab 34. As discussed further below, each of the foot 38 are complementarily shaped and sized to be accommodated within a corresponding groove 22 so as to allow for cooperative connection of the elongated wing 32 with the channel 10, for example as illustrated in FIGS. 12-15.

Figure 16:
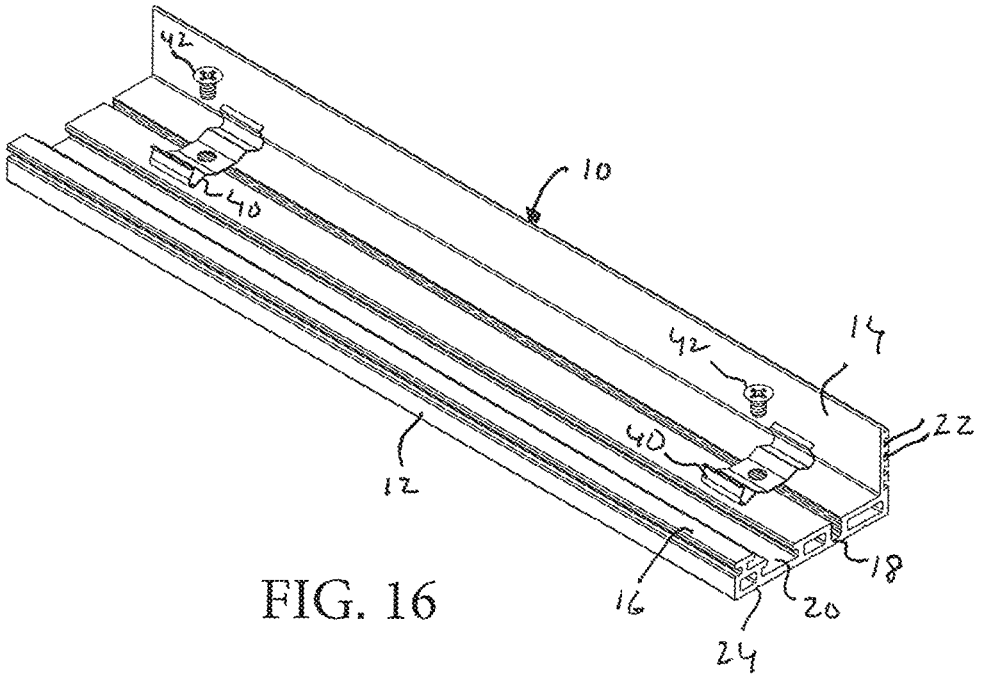
FIG. 16 is a partially exploded perspective view of a stage of an exemplary installation process for the lighting assembly according to an exemplary aspect of the present invention.
Figure 17:
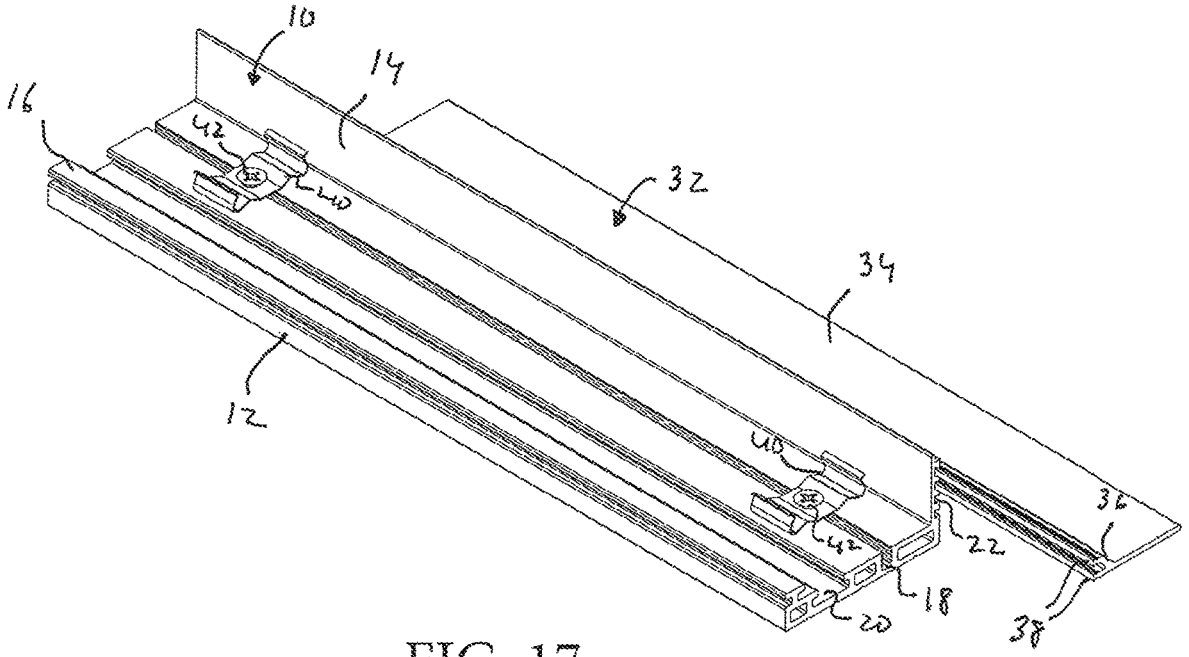
FIG. 17 is a partially assembled perspective view of a stage of an exemplary indirect lighting installation process for the lighting assembly according to an exemplary aspect of the present invention.
Figure 20:
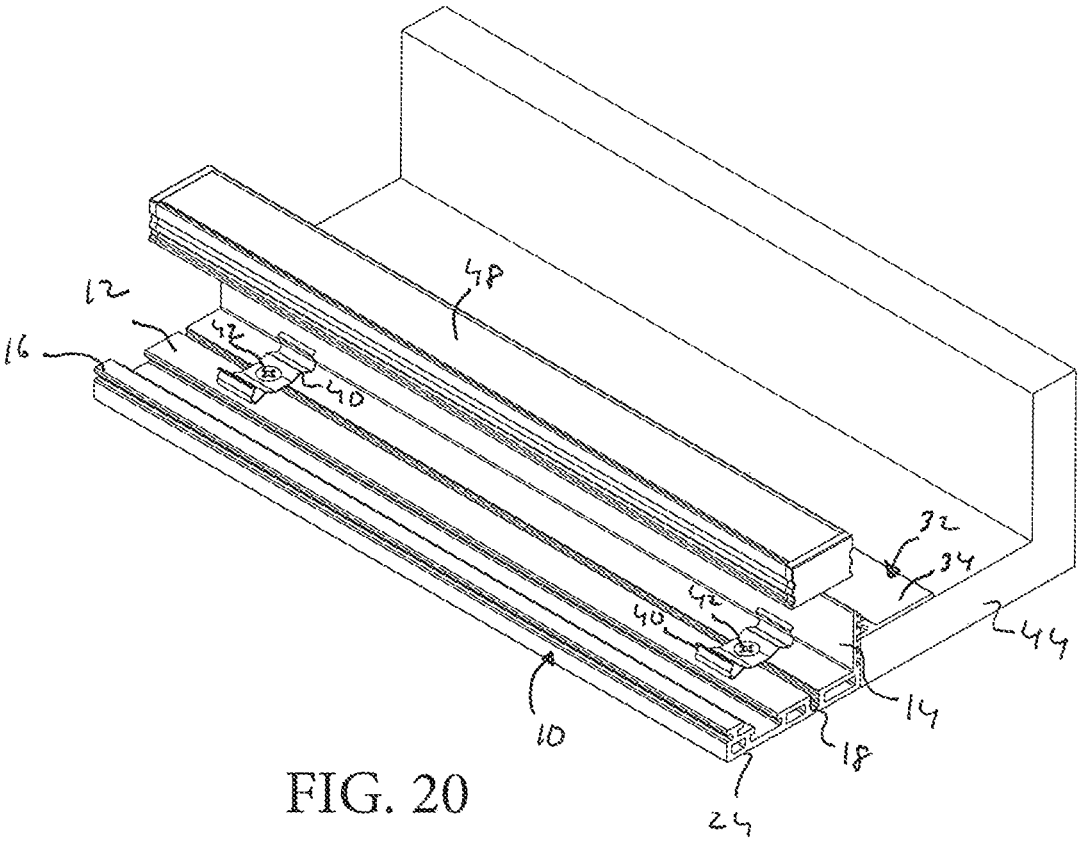
FIG. 20 is a partially exploded perspective view of a stage of an exemplary indirect lighting installation process for the lighting assembly according to an exemplary aspect of the present invention.
Figure 21:
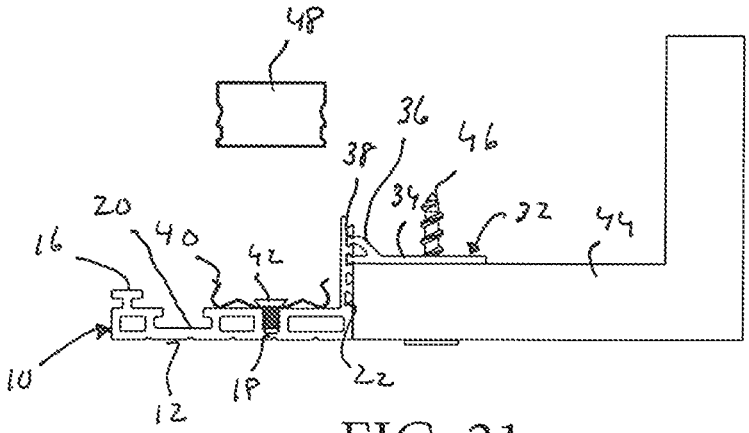
FIG. 21 is a partially exploded front view of a stage of an exemplary indirect lighting installation process for the lighting assembly according to an exemplary aspect of the present invention.
Figure 22:
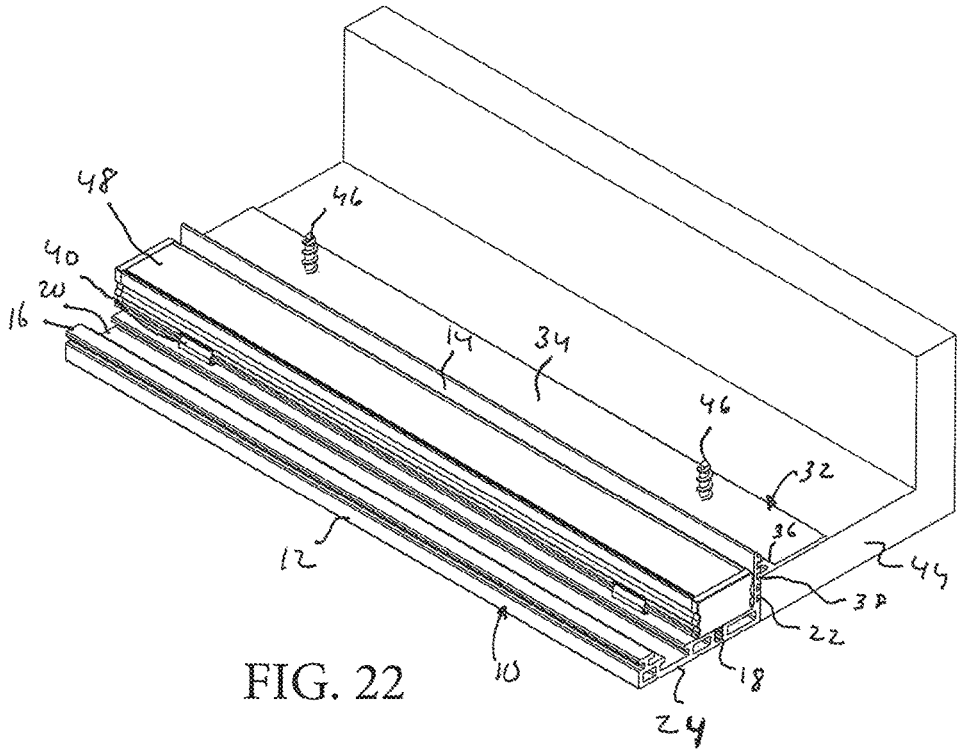
FIG. 22 is a perspective view of a stage of an exemplary indirect lighting installation process for the lighting assembly according to an exemplary aspect of the present invention.
Figure 23:
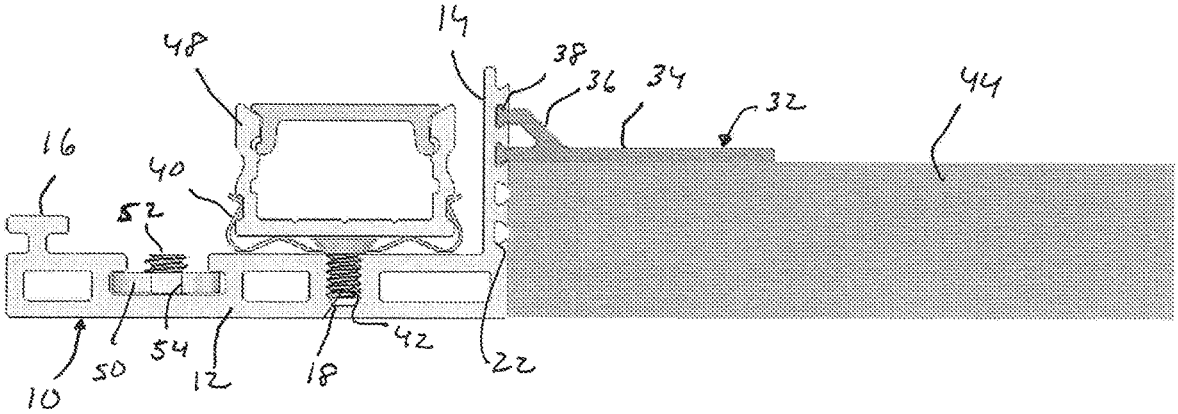
FIG. 23 is a front view of a stage of an exemplary indirect lighting installation process for the lighting assembly according to an exemplary aspect of the present invention.

Referring now to FIGS. 16-23, installation and use of the lighting assembly according to an exemplary aspect of the present invention for an indirect lighting application will now be discussed. It is generally understood for the purposes of the following discussion that an indirect lighting application refers to a lighting application in which the primary direction of light emitted from the lighting assembly is away from a surface or area to be illuminated. However, it is further understood that an indirect lighting application does not require that any light emitted from the lighting assembly reach, either directly or through reflection, the surface or area to be illuminated. As shown in FIG. 16, one or more mounting clips 40 may be secured to the threaded track 18 of the body base 12 by one or more clip fasteners 42, for example a flat head screw or bolt. As shown in FIG. 17, the elongated wing 32 may then be engaged with the channel 10 by sliding the one or more foot 38 into corresponding grooves 22 in the wall 14. For an indirect lighting application, the arm 36 of the elongated wing 32 preferably should be positioned away from the body base 12 of the channel 10 so that the larger flat surface area of the slab 34 is facing in the direction towards the body base 12 of the channel 10. As shown in FIGS. 18 and 19, the channel 10 with the elongated wing 32 installed thereon may be affixed to a wallboard 44, for example drywall, by one or more wall fasteners 46, for example screws or nails. The one or more wall fasteners 46 may, with or without a pre-drilled pilot hole, be inserted through the wallboard 44 and the elongated wing 32 in order to secure the channel 10 to the wallboard 44. As shown for example in FIG. 23, the positioning of the elongated wing 32 relative to the channel 10 may be adjusted so that the surface of the channel 10 on the side of the body base 12 opposite the wall 14 is substantially flush with the surface of the wallboard 44. The positioning of the elongated wing 32 relative to the channel 10 may be selected by inserting the one or more foot 38 into the appropriate corresponding groove 22 of the wall 14 so that the distance between the elongated wing 32 and the bottom of the body base 12 is substantially equal to the thickness of the wallboard 44. As shown in FIGS. 20-23, a lighting element 48, for example a light emitting diode (LED) lighting fixture, may be inserted into the one or more mounting clips 40 and disposed on the channel 10. The lighting element 48 may be any suitable lighting element that is configured for attachment to the channel 10 through the use of the one or more mounting clips 40 or other attachment devices, such as mechanical fasteners, adhesives, magnets and/or tape. The channel 10 may be visually integrated with the wallboard 44 by applying suitable joint compound, plaster and/or paint to the side of the body base 12 having the one or more furrows 24, and the furrows 24 may facilitate application of the material and integration of the channel 10 with the wallboard 44.

Figure 24:
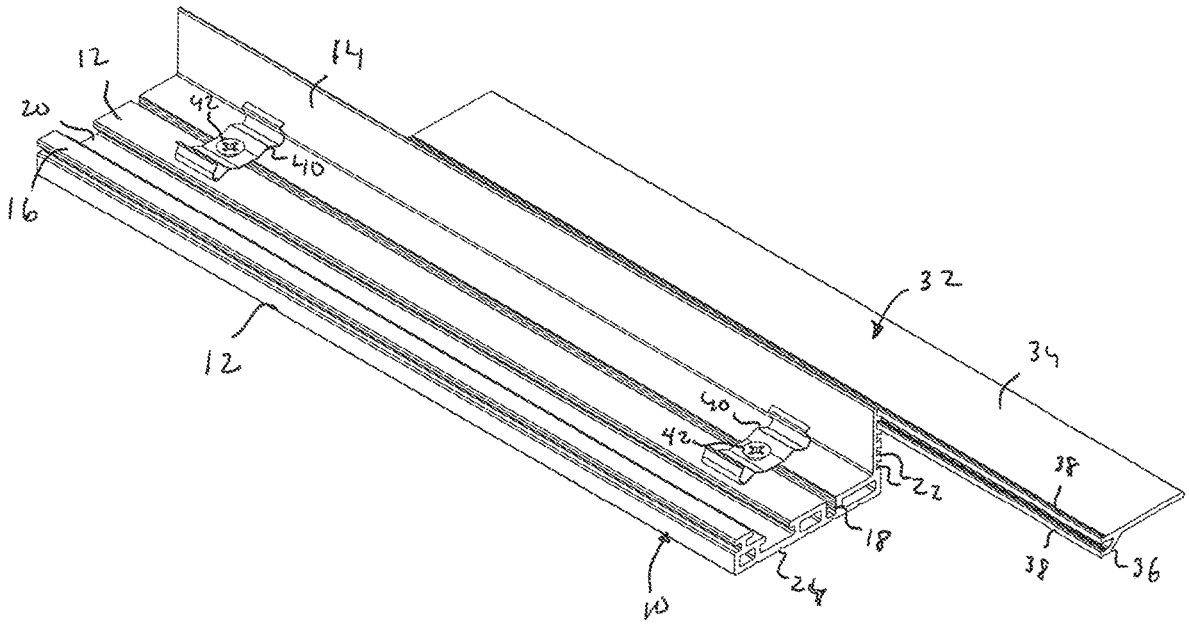
FIG. 24 is a partially assembled perspective view of a stage of an exemplary direct lighting installation process for the lighting assembly according to an exemplary aspect of the present invention.
Figure 25:
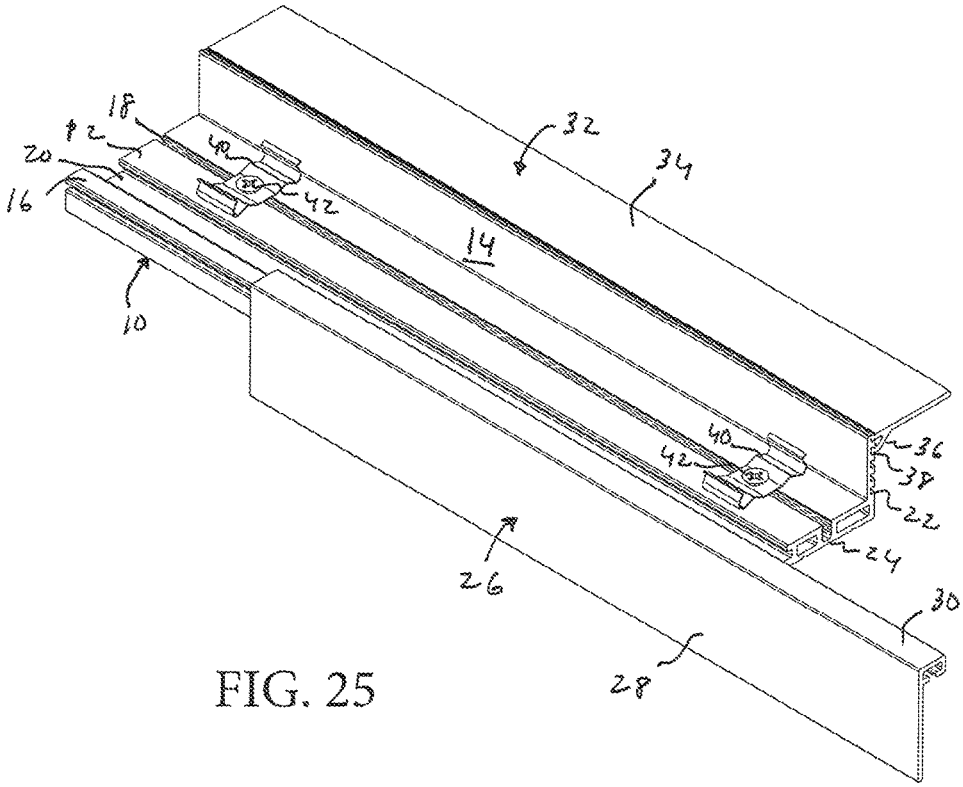
FIG. 25 is a partially assembled perspective view of a stage of an exemplary direct lighting installation process for the lighting assembly according to an exemplary aspect of the present invention.
Figure 25A:
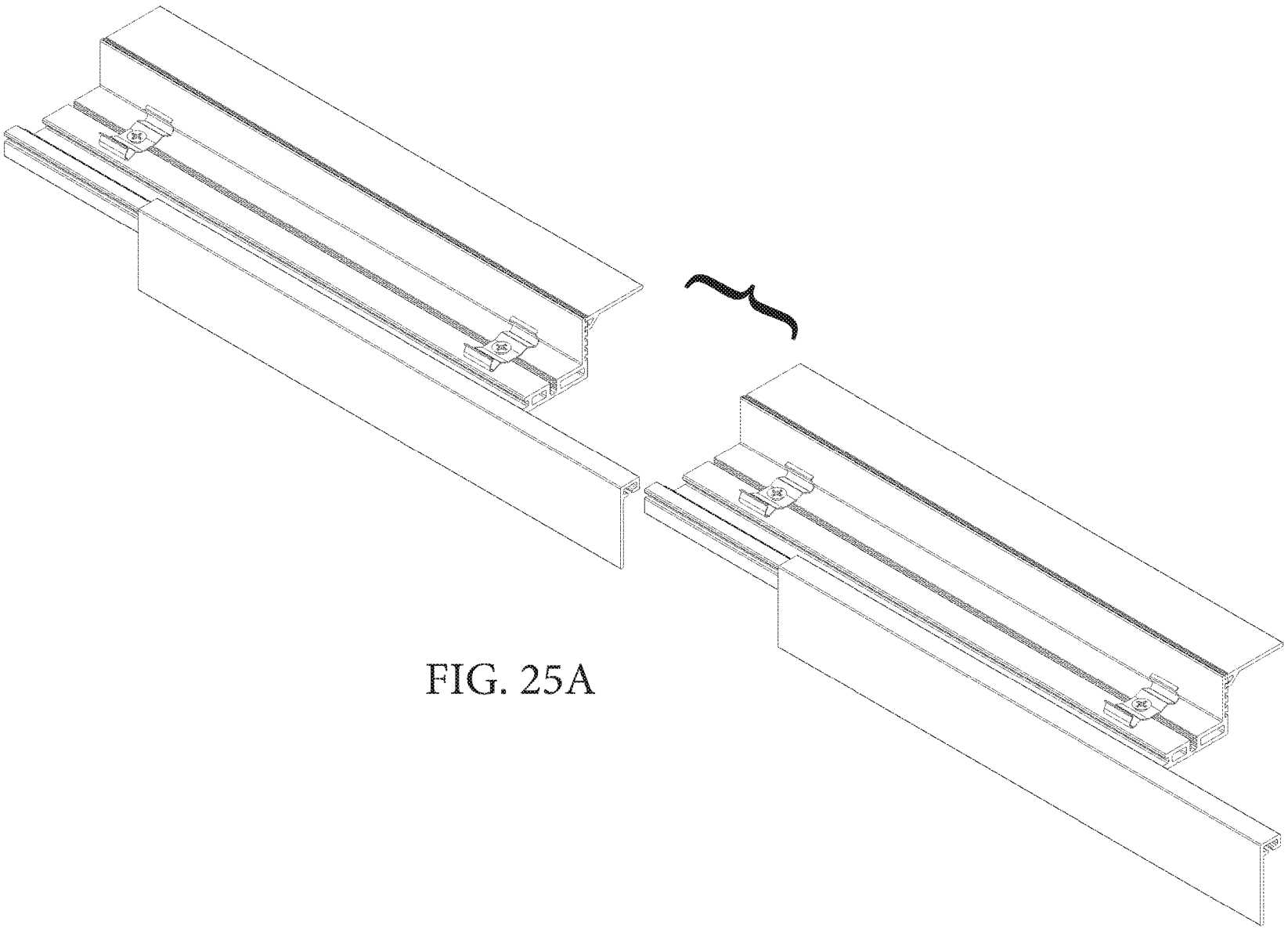
FIG. 25A is the view from FIG. 25 having a symbolic break illustrating that the lighting assembly may have an indeterminate length.
Figure 26:
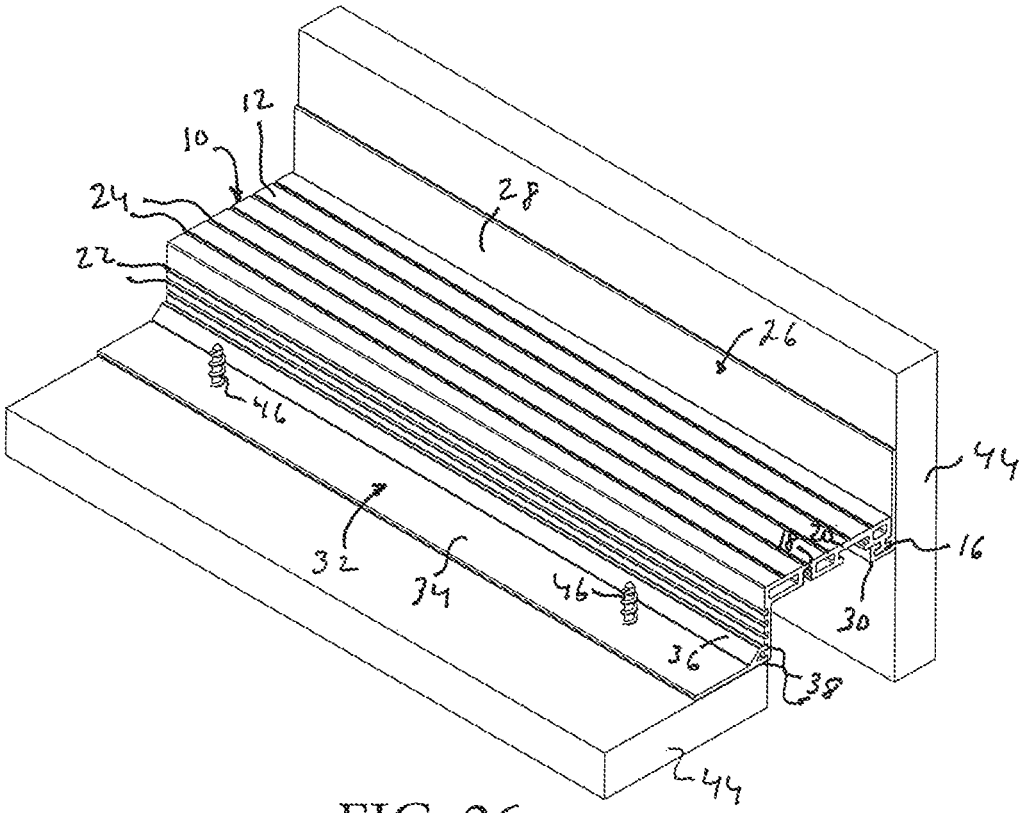
FIG. 26 is a perspective view of a stage of an exemplary direct lighting installation process for the lighting assembly according to an exemplary aspect of the present invention.
Figure 27:
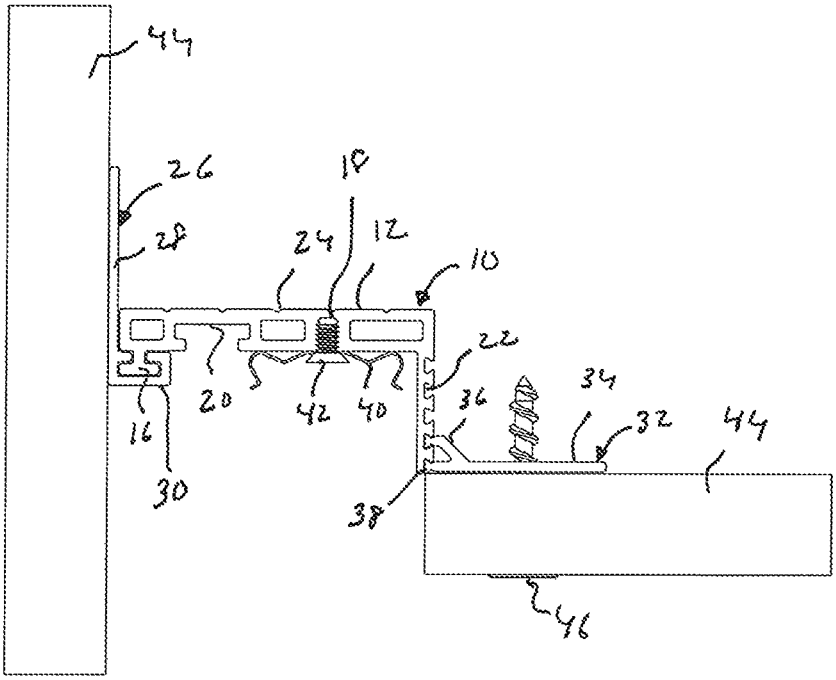
FIG. 27 is a front view of a stage of an exemplary direct lighting installation process for the lighting assembly according to an exemplary aspect of the present invention.
Figure 26A:
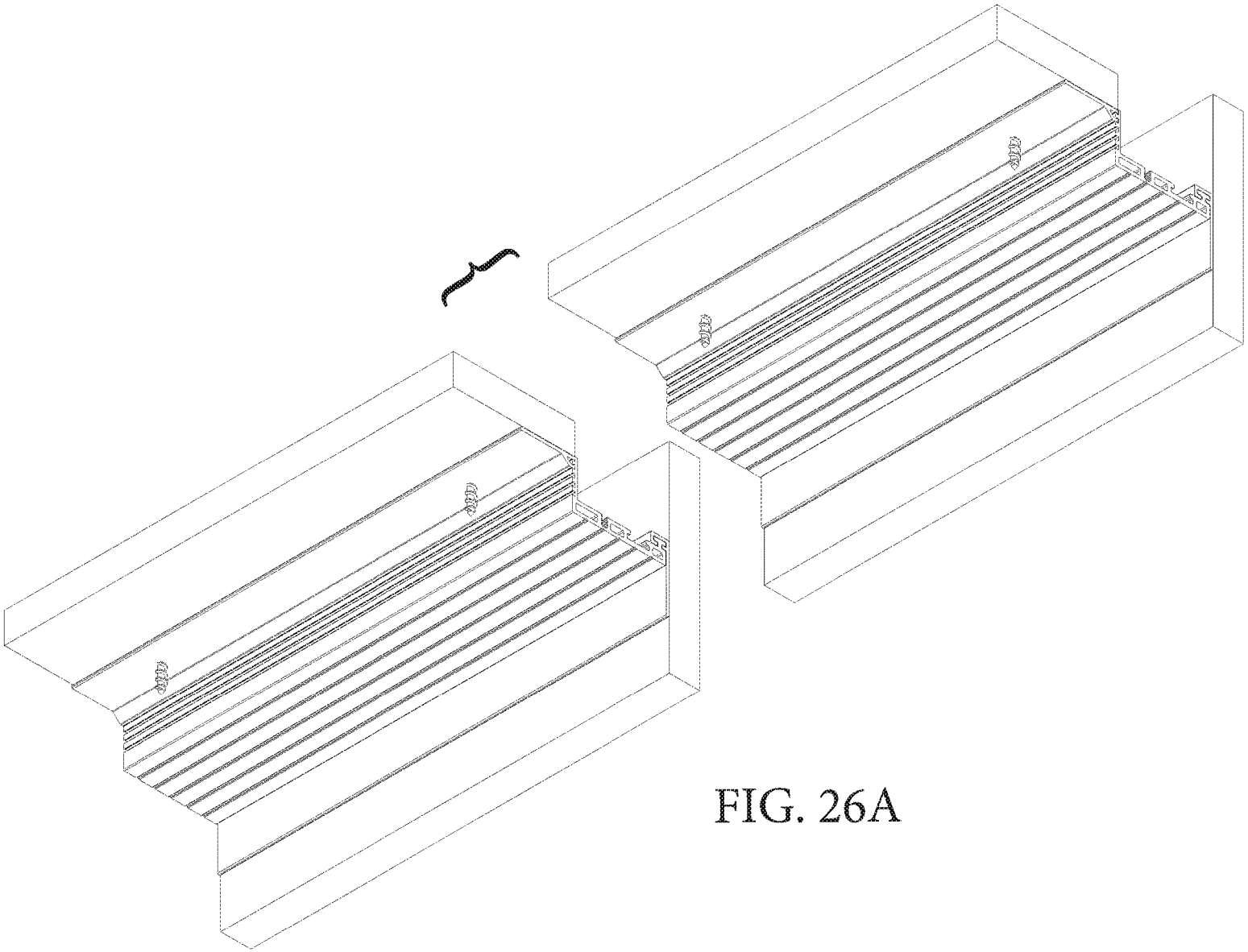
FIG. 26A is the view from FIG. 26 having a symbolic break illustrating that the lighting assembly may have an indeterminate length.
Figure 28:
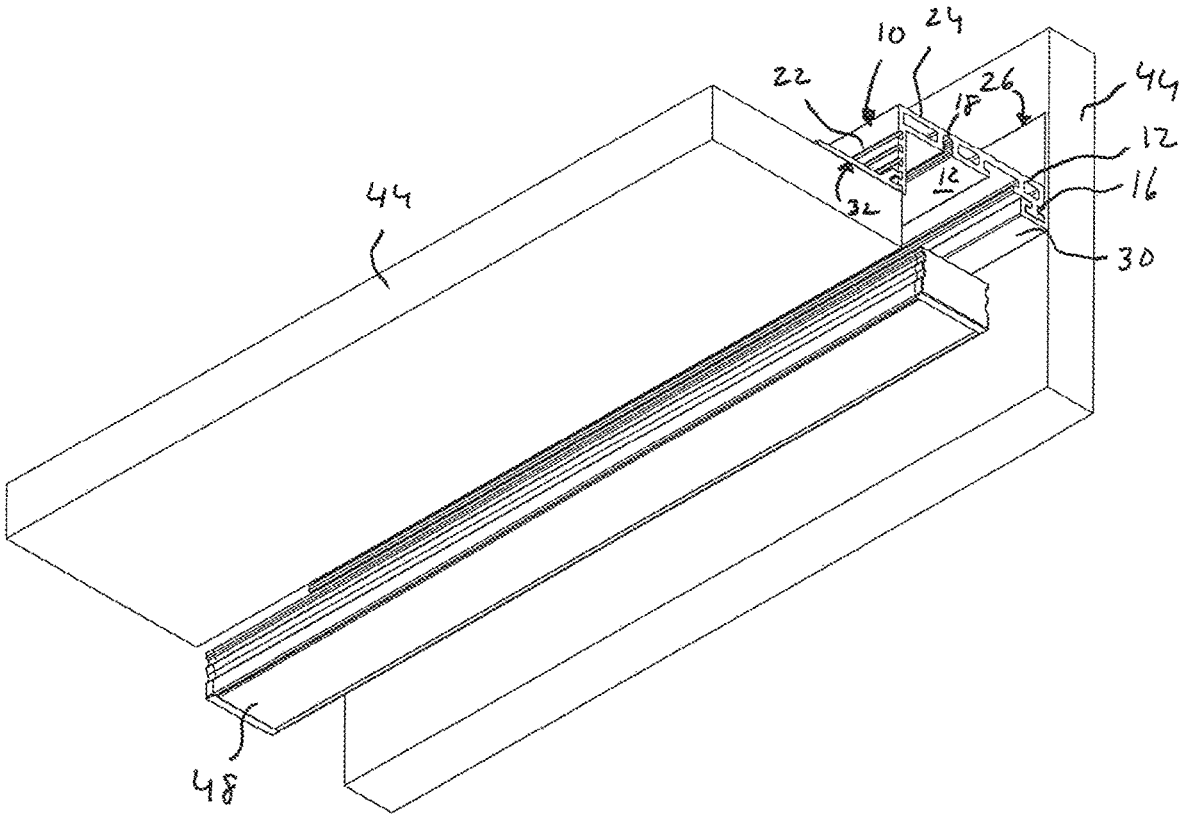
FIG. 28 is a partially exploded perspective view of a stage of an exemplary direct lighting installation process for the lighting assembly according to an exemplary aspect of the present invention.
Figure 29:
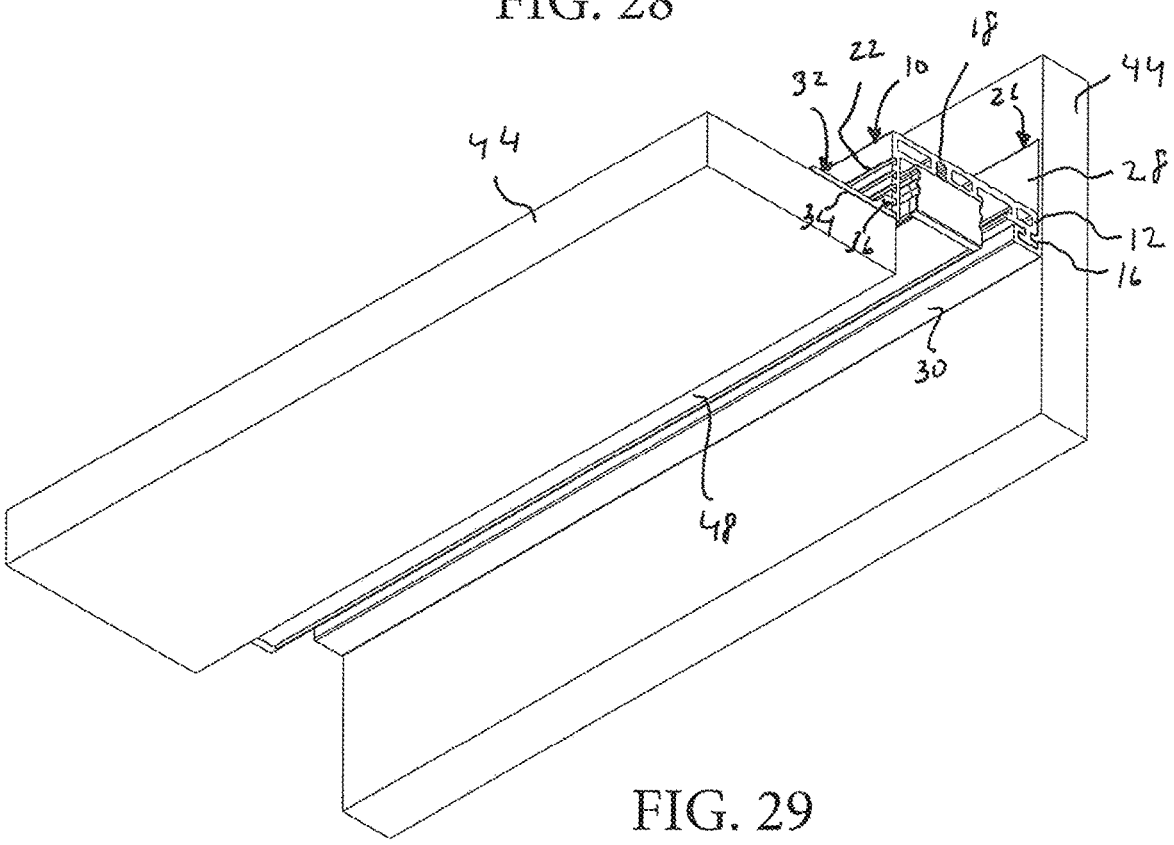
FIG. 29 is a perspective view of a stage of an exemplary direct lighting installation process for the lighting assembly according to an exemplary aspect of the present invention.
Figure 30:
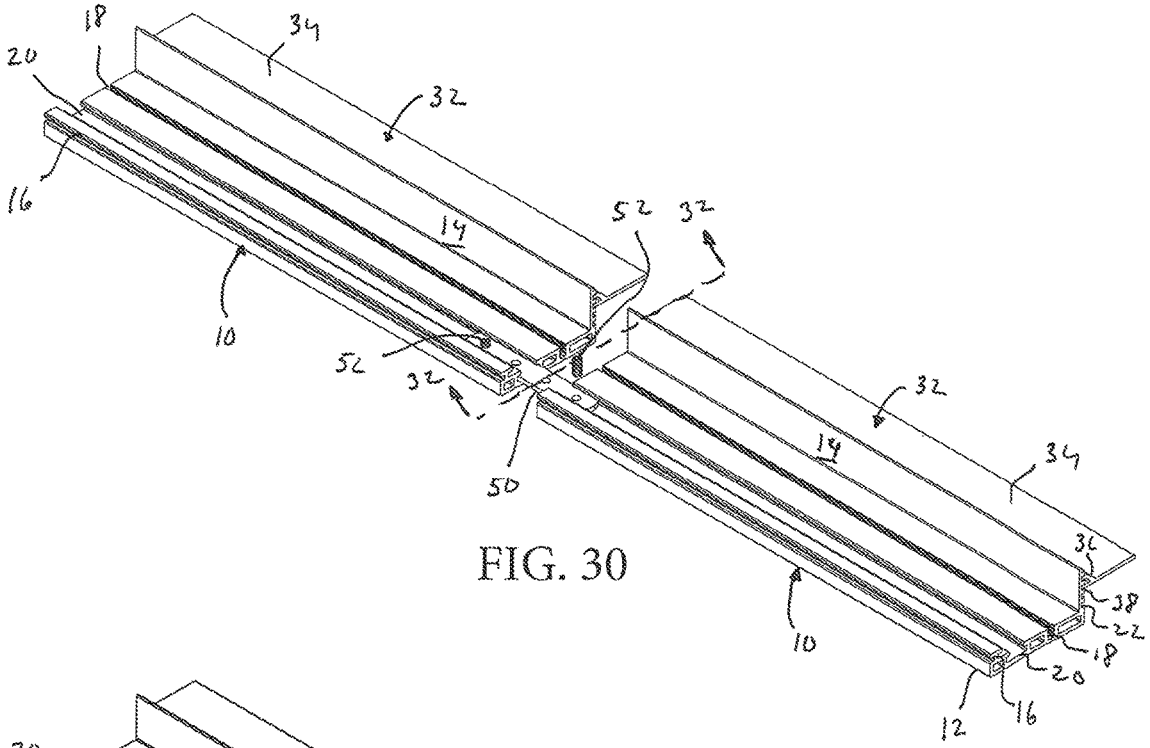
FIG. 30 is a partially exploded perspective view of a straight connection of two lighting assemblies according to an exemplary aspect of the present invention.
Figure 31:
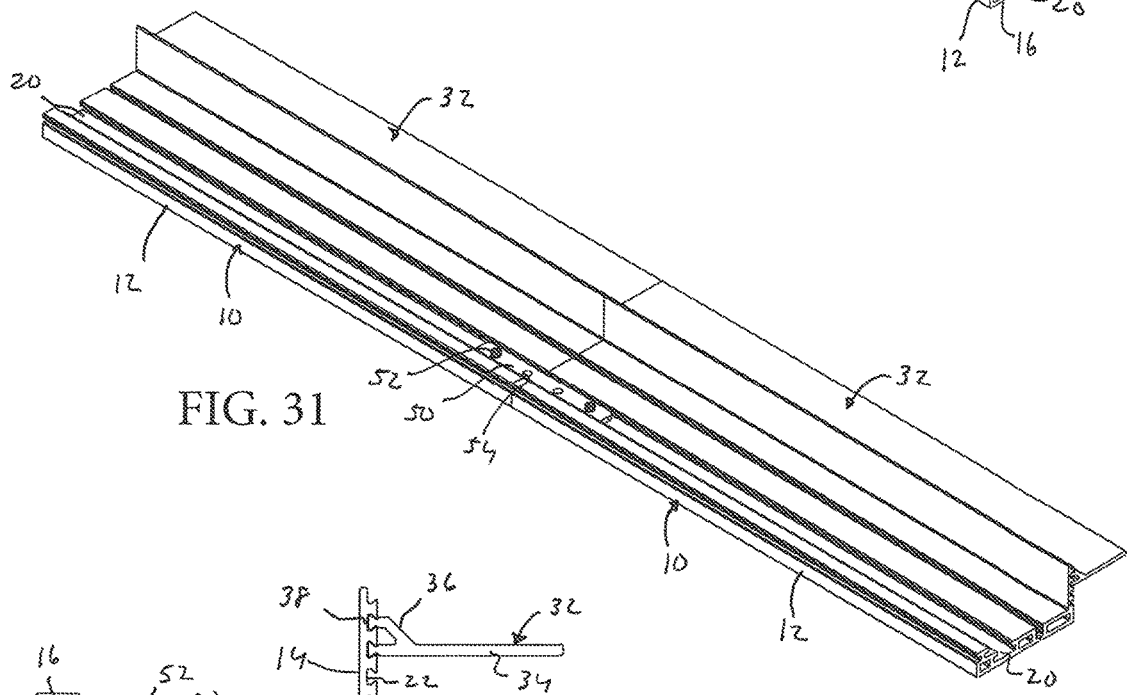
FIG. 31 is a perspective view of a straight connection of two lighting assemblies according to an exemplary aspect of the present invention.
Figure 32:
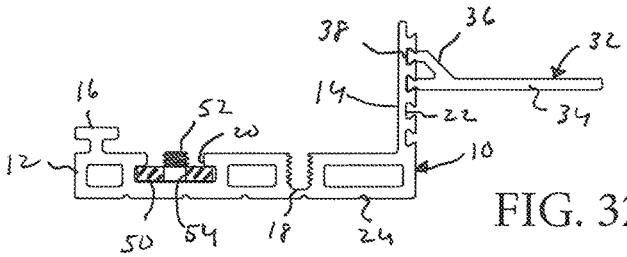
FIG. 32 is a cross-sectional view taken alone line 32-32 from FIG. 30.
Figure 33:
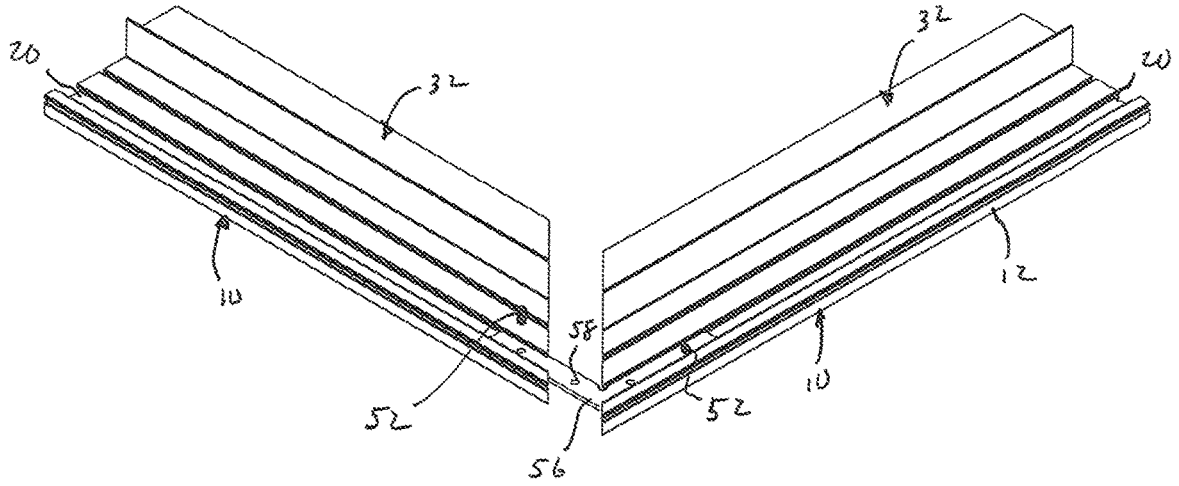
FIG. 33 is a partially exploded perspective view of a mitered connection of two lighting assemblies according to an exemplary aspect of the present invention.
Figure 34:
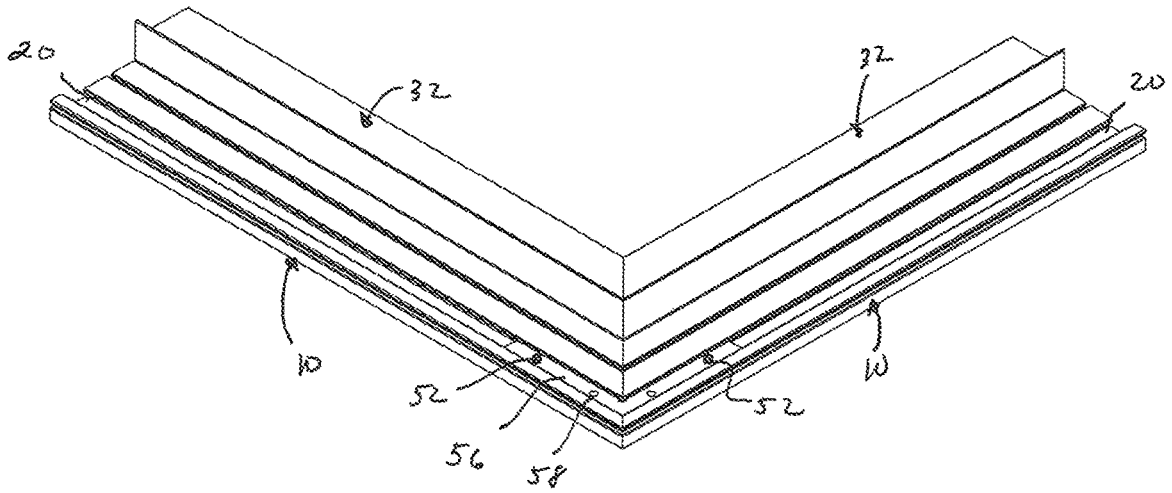
FIG. 34 is a perspective view of a mitered connection of two lighting assemblies according to an exemplary aspect of the present invention.

Referring now to FIGS. 16 and 24-29, installation and use of the lighting assembly according to an exemplary aspect of the present invention for a direct lighting application will now be discussed. It is generally understood for the purposes of the following discussion that a direct lighting application refers to a lighting application in which the primary direction of light emitted from the lighting assembly is towards a surface or area to be illuminated. However, it is further understood that a direct lighting application does not require that all light emitted from the lighting assembly reach, either directly or through reflection, the surface or area to be illuminated. As shown in FIG. 16, one or more mounting clips 40 may be secured to the threaded track 18 of the body base 12 by one or more clip fasteners 42, for example a flat head screw or bolt. As shown in FIG. 24, the elongated wing 32 may then be engaged with the channel 10 by sliding the one or more foot 38 into corresponding grooves 22 in the wall 14. For a direct lighting application, the arm 36 of the elongated wing 32 preferably should be positioned towards the body base 12 of the channel 10 so that the larger flat surface area of the slab 34 is facing in the direction away from the body base 12 of the channel 10. As shown in FIG. 25, the elongated strip 26 may then be affixed to the channel 10 by sliding the raceway 30 of the elongated strip 26 along the rail 16 of the channel 10. As shown in FIGS. 26 and 27, the channel 10 with the elongated wing 32 and panel 26 installed thereon may be affixed to a wallboard 44, for example drywall, by one or more wall fasteners 46, for example screws or nails. The one or more wall fasteners 46 may, with or without a pre-drilled pilot hole, be inserted through the wallboard 44 and the elongated wing 32 in order to secure the channel 10 to the wallboard 44. Additional fasteners (not shown) may also be used to secure the panel 26 to the wallboard 44, or the panel 26 may act as a support for the channel 10 against the wallboard 44. Positioning of the elongated wing 32 relative to the channel 10 may be adjusted so that the channel 10 is recessed the desired amount relative to the wallboard 44. The positioning of the elongated wing 32 relative to the channel 10 may be selected by inserting the one or more foot 38 into the appropriate corresponding groove 22 of the wall 14. As shown in FIGS. 28 and 29, a lighting element 48, for example a light emitting diode (LED) lighting fixture, may be inserted into the one or more mounting clips 40 and disposed on the channel 10. The lighting element 48 may be any suitable lighting element that is configured for attachment to the channel 10 through the use of the one or more mounting clips 40 or other attachment devices, such as mechanical fasteners, adhesives, magnets and/or tape. The channel 10 may be visually integrated with the wallboard 44 by applying suitable joint compound, plaster and/or paint to the side of the body base 12 having the one or more furrows 24, and the furrows 24 may facilitate application of the material and integration of the channel 10 with the wallboard 44.

Referring now to FIGS. 8-11 and 30-34, the joining of lengths of the lighting assembly will be discussed. Straight lengths of the lighting assembly may be joined and connected through the use of a straight connector 50. The straight connector 50 may be inserted into the slot 20 in one of the channels 10 to be connected. A set screw 52 may be threaded into a threaded hole 54 in the straight connector 50, and the threading of the set screw 52 into the threaded hole 54 urges the straight connector 50 into a secure connection with the slot 20 by urging the straight connector 50 against the underside of the slot 20. A slot 20 in a second channel 10 may then positioned to accept the other end of the straight connector 50 and the two channels 10 urged together so that corresponding ends of the channels are butted together. Another set screw 52 may then be threaded into a threaded hole 54 of the straight connector 50 in order to secure the channel 10 to the straight connector 50 as discussed above. Likewise, mitered lengths of the lighting assembly may be joined to produce angled connection by using a miter connector 56. The miter connector 56 may be inserted into the slot 20 in one of the channels 10 to be connected. A set screw 52 may be threaded into a threaded hole 58 in the miter connector 56, and the threading of the set screw 52 into the threaded hole 58 urges the miter connector 56 into a secure connection with the slot 20 by urging the miter connector 56 against the underside of the slot 20. A slot 20 in a second channel 10 may then positioned to accept the other end of the miter connector 56 and the two channels 10 urged together so that corresponding ends of the channels are butted together. Another set screw 52 may then be threaded into a threaded hole 58 of the miter connector 56 in order to secure the channel 10 to the miter connector 56 as discussed above.

The channel 10 may be constructed of any suitable material, for example, aluminum or other metal, or a plastic. The panel 26 and the elongated wing 32 may likewise be constructed of a suitable metal, such as aluminum, or a plastic.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention.

Numerous modifications and alternative arrangements may be devised by those skilled in the art without departing from the scope of the present invention.

What is claimed is:

1. A lighting assembly, comprising:

a channel having a body base and a wall extending substantially perpendicularly from a side of the body base; and an elongated wing positionable on the wall at a plurality of elevations relative to the body base such that at each of the plurality of elevations the elongated wing is substantially parallel to the body base;

wherein the elongated wing comprises a slab with a first substantially flat side, and a second side opposite the first substantially flat side from which an arm extends;

wherein the channel further comprises a plurality of grooves formed in a side of the wall facing opposite the body base;

wherein the elongated wing further comprises a first foot extending from the slab, and a second foot extending from the arm; and wherein the first foot is configured to slidenly engage with a first groove of the plurality of grooves of the wall, and the second foot is configured to slidenly engage with a second groove of the plurality of grooves of the wall.

2. The lighting assembly according to claim 1, further comprising a panel having an elongated strip and a raceway positioned at least substantially perpendicular to the elongated strip.

3. The lighting assembly according to claim 2, wherein the channel further comprises a rail extending from the other side of the body base opposite the wall, and wherein the rail is configured for slidenly engagement with the raceway of the panel.

4. The lighting assembly according to claim 1, wherein the second groove of the plurality of grooves of the wall is adjacent to the first groove of the plurality of grooves of the wall.

5. The lighting assembly according to claim 1, wherein the channel further comprises one or more threaded tracks extending along the body base.

6. The lighting assembly according to claim 5, wherein the one or more threaded tracks are configured for receipt of one or more fasteners to secure one or more clip fasteners to the body base.

7. The lighting assembly according to claim 6, wherein the one or more clip fasteners are configured to receive and retain one or more lighting elements.

8. The lighting assembly according to claim 1, wherein the channel further comprises one or more slots extending along the body base.

* * * * *